US009848687B2

(12) United States Patent
Valesko

(10) Patent No.: US 9,848,687 B2
(45) Date of Patent: Dec. 26, 2017

(54) ADJUSTABLE STRAP HEIGHT MECHANISM

(71) Applicant: Joseph Ethan Valesko, West Melbourne, FL (US)

(72) Inventor: Joseph Ethan Valesko, West Melbourne, FL (US)

( * ) Notice: Subject to any disclaimer, the term of this patent is extended or adjusted under 35 U.S.C. 154(b) by 80 days.

(21) Appl. No.: 14/985,987

(22) Filed: Dec. 31, 2015

(65) Prior Publication Data

US 2017/0188689 A1 Jul. 6, 2017

(51) Int. Cl.
*A45F 3/04* (2006.01)

(52) U.S. Cl.
CPC ..... *A45F 3/047* (2013.01)

(58) Field of Classification Search
CPC ..... A45F 3/047
USPC ..... 224/631
See application file for complete search history.

(56) References Cited

U.S. PATENT DOCUMENTS

| | | | | |
|---|---|---|---|---|
| 2,611,519 | A | 9/1962 | Ludvig | |
| 3,347,429 | A | 10/1967 | Ruth | |
| 3,536,237 | A | 10/1970 | Greenman | |
| 3,840,162 | A | 10/1974 | Horenstein | |
| 3,885,722 | A | 5/1975 | Robertson | |
| 4,318,502 | A | 3/1982 | Lowe et al. | |
| 4,361,259 | A | 11/1982 | Chanter | |
| 4,479,595 | A | 10/1984 | Opsal | |
| 5,110,459 | A | 5/1992 | Thatcher | |
| 5,178,309 | A | 1/1993 | Bicheler et al. | |
| 5,181,638 | A | 1/1993 | McHale | |
| 5,361,955 | A | 11/1994 | Gregory | |
| 5,366,126 | A | 11/1994 | Dausien | |
| 5,465,886 | A | 11/1995 | Scherer | |
| 5,497,922 | A | 3/1996 | Tate | |
| 5,529,229 | A | 6/1996 | Fier | |
| 5,553,759 | A | 9/1996 | McMaster et al. | |
| 5,586,699 | A | 12/1996 | Heisler et al. | |
| 5,586,705 | A * | 12/1996 | Leonard | A45F 3/047 224/627 |
| 5,725,139 | A | 3/1998 | Smith | |
| 5,730,347 | A | 3/1998 | Finot | |
| 5,762,251 | A * | 6/1998 | Gleason | A45F 3/08 224/635 |
| 5,918,785 | A | 7/1999 | Irose | |
| 5,954,253 | A | 9/1999 | Swetish | |
| 5,961,014 | A | 10/1999 | Knerr | |

(Continued)

FOREIGN PATENT DOCUMENTS

| | | | |
|---|---|---|---|
| DE | 19605207 | A1 * | 8/1996 |
| DE | 19932499 | C2 * | 12/2003 |

(Continued)

*Primary Examiner* — Justin Larson
(74) *Attorney, Agent, or Firm* — Kelly G. Swartz; Widerman Malek, PL

(57) ABSTRACT

A strap height adjustment apparatus including a backpack, a locking strap adjuster, a non-locking strap adjuster, an adjusting strap, and a shoulder strap. The locking strap adjuster is secured to the backpack at a first attachment point. The non-locking strap adjuster secured to the backpack at a second attachment point. The adjusting strap is configured to be carried by the locking strap adjuster and the non-locking strap adjuster. The shoulder strap is secured to the adjusting strap at a shoulder strap attachment point.

19 Claims, 5 Drawing Sheets

(56) References Cited

U.S. PATENT DOCUMENTS

| | | | | |
|---|---|---|---|---|
| 5,971,244 | A * | 10/1999 | Jaeger | A45F 3/08 224/632 |
| 6,053,381 | A | 4/2000 | Fahl et al. | |
| 6,152,343 | A | 11/2000 | Shin | |
| 6,179,188 | B1 | 1/2001 | Gleason | |
| 6,347,730 | B1 | 2/2002 | Frederick | |
| 6,581,812 | B2 | 6/2003 | Roscoe-Dare | |
| 6,607,107 | B2 | 8/2003 | Dexheimer | |
| 6,651,853 | B2 | 11/2003 | Higgins et al. | |
| 7,004,362 | B2 | 2/2006 | Boone | |
| 7,152,771 | B2 * | 12/2006 | Le Gal | A45F 3/047 224/631 |
| 7,232,048 | B2 * | 6/2007 | Le Gal | A45F 3/04 224/201 |
| 7,770,769 | B2 * | 8/2010 | Hurn | A45F 3/047 224/579 |
| 8,028,871 | B2 | 10/2011 | Gray | |
| 8,066,164 | B2 | 11/2011 | Gregory | |
| 8,157,138 | B2 * | 4/2012 | Leyendecker | A45F 3/04 224/153 |
| 8,181,833 | B2 | 5/2012 | Wangeby et al. | |
| 8,381,956 | B2 | 2/2013 | Gleason | |
| 8,544,709 | B2 * | 10/2013 | Paik | A45F 3/04 224/632 |
| 8,672,203 | B2 | 3/2014 | Staudecker et al. | |
| 8,833,624 | B2 | 9/2014 | Miyamoto | |
| 8,960,511 | B2 | 2/2015 | Shepherd et al. | |
| 9,119,460 | B2 | 9/2015 | Ables | |
| 2003/0192925 | A1 | 10/2003 | Boone | |
| 2004/0144820 | A1 | 7/2004 | Herold | |
| 2004/0178245 | A1 * | 9/2004 | Le Gal | A45F 3/047 224/631 |
| 2005/0087577 | A1 | 4/2005 | Thompson | |
| 2006/0102675 | A1 | 5/2006 | Bezak et al. | |
| 2006/0131355 | A1 | 6/2006 | Tate | |
| 2010/0237122 | A1 | 9/2010 | Toledo | |
| 2010/0301086 | A1 | 12/2010 | Smith | |
| 2011/0284609 | A1 | 11/2011 | McGill et al. | |
| 2011/0309124 | A1 | 12/2011 | DuBois et al. | |
| 2012/0286006 | A1 | 11/2012 | Wegener | |
| 2012/0325872 | A1 | 12/2012 | Mutoh et al. | |
| 2013/0341369 | A1 | 12/2013 | Kacmarcik | |
| 2015/0028077 | A1 | 1/2015 | Ghassemi | |

FOREIGN PATENT DOCUMENTS

| | | | |
|---|---|---|---|
| FR | 2569961 | A1 * | 3/1986 |
| FR | 2695016 | B3 * | 7/1994 |
| FR | 2956798 | B1 * | 4/2012 |
| GB | 2303056 | A * | 2/1997 |

* cited by examiner

ADJUSTABLE STRAP HEIGHT MECHANISM

FIELD OF THE INVENTION

This invention relates generally to backpacks. More specifically, this invention relates to a mechanism that adjusts the height of the attachment point of a backpack shoulder strap to a backpack.

BACKGROUND

This background information is provided to reveal information believed by the applicant to be of possible relevance to the present invention. No admission is necessarily intended, nor should be construed, that any of the preceding information constitutes prior art against the present invention.

A conventional backpack includes shoulder straps worn over the shoulders of the user, waist straps fastened across the waist of the user, and chest straps fastened across the chest of the user.

The shoulder straps serve to support the backpack, and the waist straps and the chest straps serve to prevent the backpack from tilting backwards and to more stably adhere the backpack to the body of the user so as to prevent the backpack from swinging while keeping a state in which the user stably wears the backpack.

In conventional backpacks, the shoulder straps, which are the principle components in supporting the backpack, do not have a length adjustment function and are fixed to the same position of the back surface of any backpack, thus being worn by users in the same shape regardless of physical characteristics of the users. That is, in conventional backpacks, the upper ends of the shoulder straps are sewn to the upper end of the back surface of the backpack, and the lower ends of the shoulder straps are connected to straps sewn to the lower end of the back surface of the backpack such that the length of the shoulder straps is adjustable. Therefore, a user has no option but to use the backpack in a state in which the upper ends of the shoulder straps are fixed to the upper end of the backpack regardless of amounts or sizes of articles received in the backpack or a size of the backpack.

If the user wears the backpack in which the upper ends of the shoulder straps are simply fixed in such a manner, the lower end of the backpack may ride excessively low or high according to the body size of the user and thus the user cannot stably wear the backpack. Therefore, when the backpack is worn for a long period of time or when mountain climbing, such an unstable worn state of the backpack provides considerable fatigue and inconvenience to the user.

For example, if a short user wears the backpack, the backpack is located at a position below the waist of the user, and thus the backpack may cause unpleasant contact with the body of the user and provide inconvenience to the user due to swinging of the lower end of the backpack during walking and the user may easily feel tired. On the other hand, if a tall user wears the backpack, the backpack is located at a position above the waist of the user, and thus the backpack may be out of balance due to upward movement of the center of gravity and the user may easily feel tired or stable walking of the user may be difficult.

Although the waist straps and the chest straps assist the backpack to be in close contact with the body of the user, the waist straps and the chest straps cannot adjust the center of gravity, thus being incapable of solving the unbalanced state of the backpack.

Accordingly, proper adjustment of a position of the shoulder straps of the backpack during contact between the backpack and the body of the user is required.

SUMMARY OF THE INVENTION

With the above in mind, embodiments of the present invention are related to a strap height adjustment apparatus including a backpack, a locking strap adjuster, a non-locking strap adjuster, an adjusting strap, and a shoulder strap. The locking strap adjuster may be secured to the backpack at a first attachment point. The non-locking strap adjuster may be secured to the backpack at a second attachment point. The adjusting strap may be configured to be carried by the locking strap adjuster and the non-locking strap adjuster. The shoulder strap may be secured to the adjusting strap at a shoulder strap attachment point.

The adjusting strap may be adapted to form a continuous loop.

The shoulder strap may be secured to an outer portion of the adjusting strap at a shoulder strap attachment point.

The shoulder strap attachment point may be configured to be adjustably positioned between the non-locking strap adjuster and the locking strap adjuster.

The locking strap adjuster may be secured to the backpack in vertical alignment with the non-locking strap adjuster.

The strap height adjustment apparatus may include a horizontal support member secured to the backpack. The locking strap adjuster may be secured to the horizontal support member.

The strap height adjustment apparatus may include an adjusting strap connection portion affixed to the shoulder strap. The adjusting strap connection portion may include an adjusting strap first end portion first side and an adjusting strap second end portion first side secured to the adjusting strap first end portion first side.

The non-locking strap adjuster and the locking strap adjuster may be affixed to an upper back half portion of the backpack.

The non-locking strap adjuster and the locking strap adjuster may be affixed to an upper back quarter portion of the backpack.

The locking strap adjuster may include a ladder lock.

The non-locking strap adjuster may include a square ring.

The strap height adjustment apparatus may include a locking strap adjuster attachment strap and a non-locking strap adjuster attachment strap. The locking strap adjuster attachment strap may be adapted to carry the locking strap adjuster and affixed to the backpack. The non-locking strap adjuster attachment strap may be adapted to carry the non-locking strap adjuster and affixed to the backpack.

The locking strap adjuster may be flexibly affixed to the backpack.

The non-locking strap adjuster may be flexibly affixed to the backpack.

The adjusting strap may include a nylon webbing material.

DETAILED DESCRIPTION OF THE INVENTION

Figure 1:
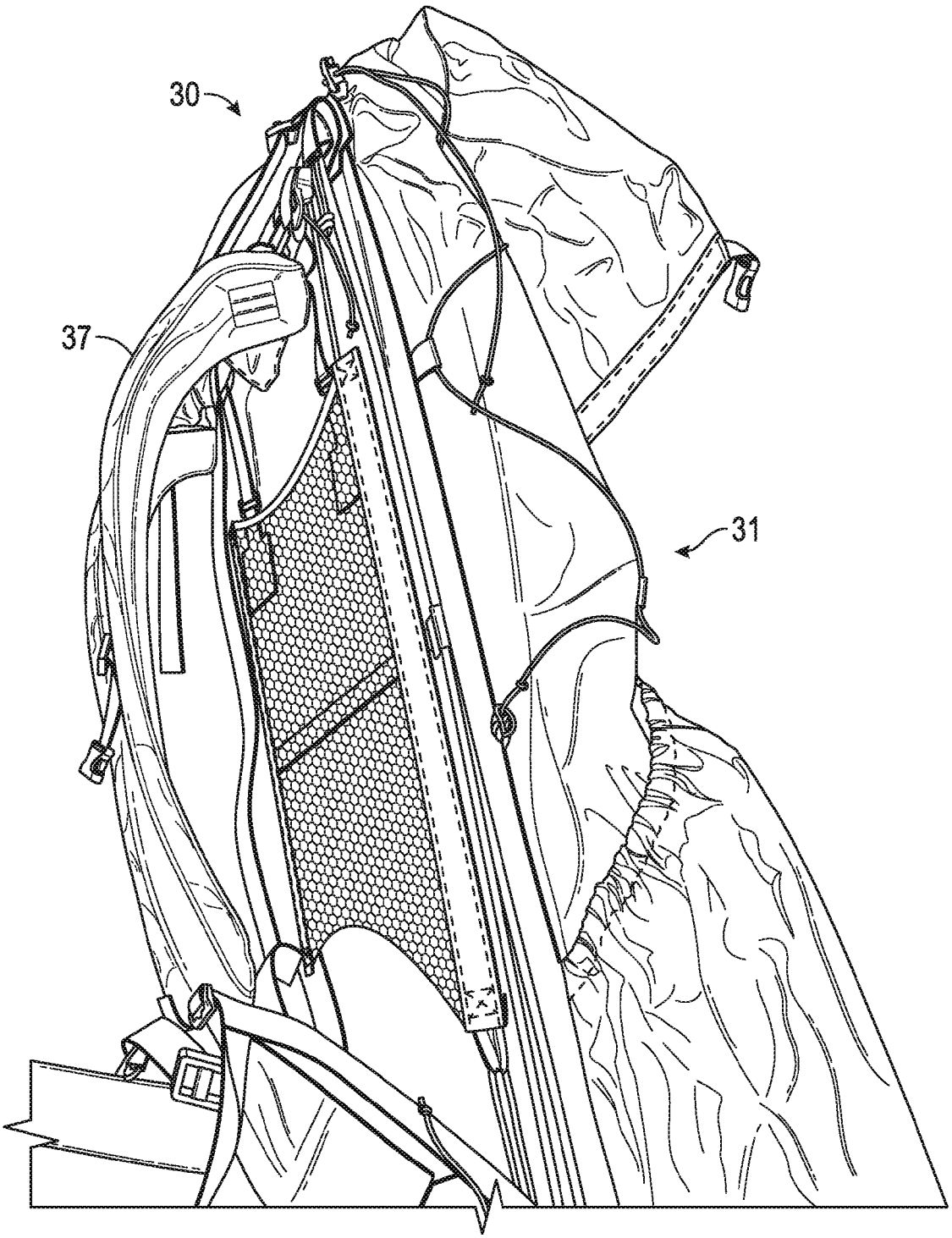
FIG. 1 is a left side elevation view of a strap height adjustment apparatus according to an embodiment of the present invention.
Figure 2:
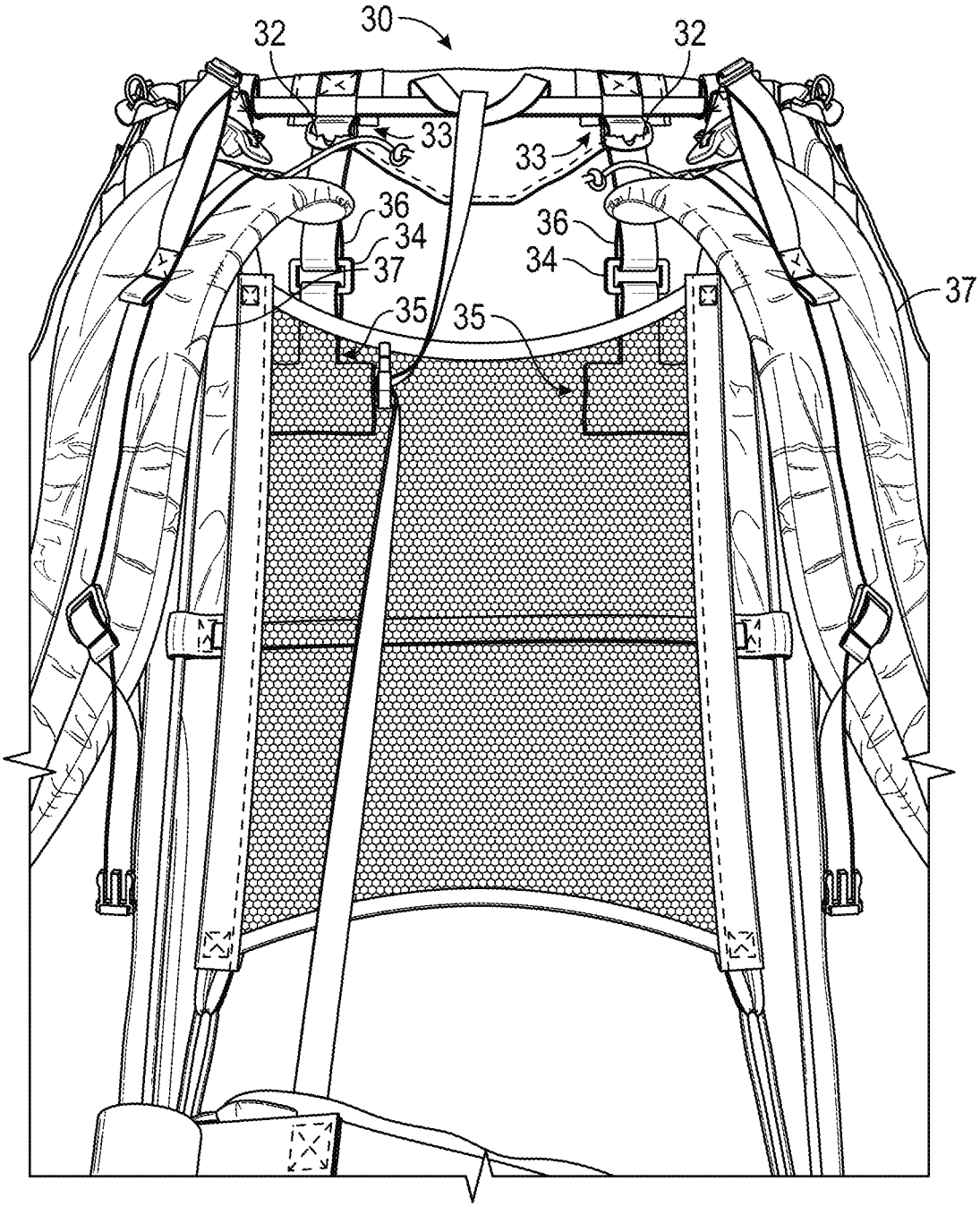
FIG. 2 is a back elevation view of the strap height adjustment apparatus of FIG. 1.
Figure 3:
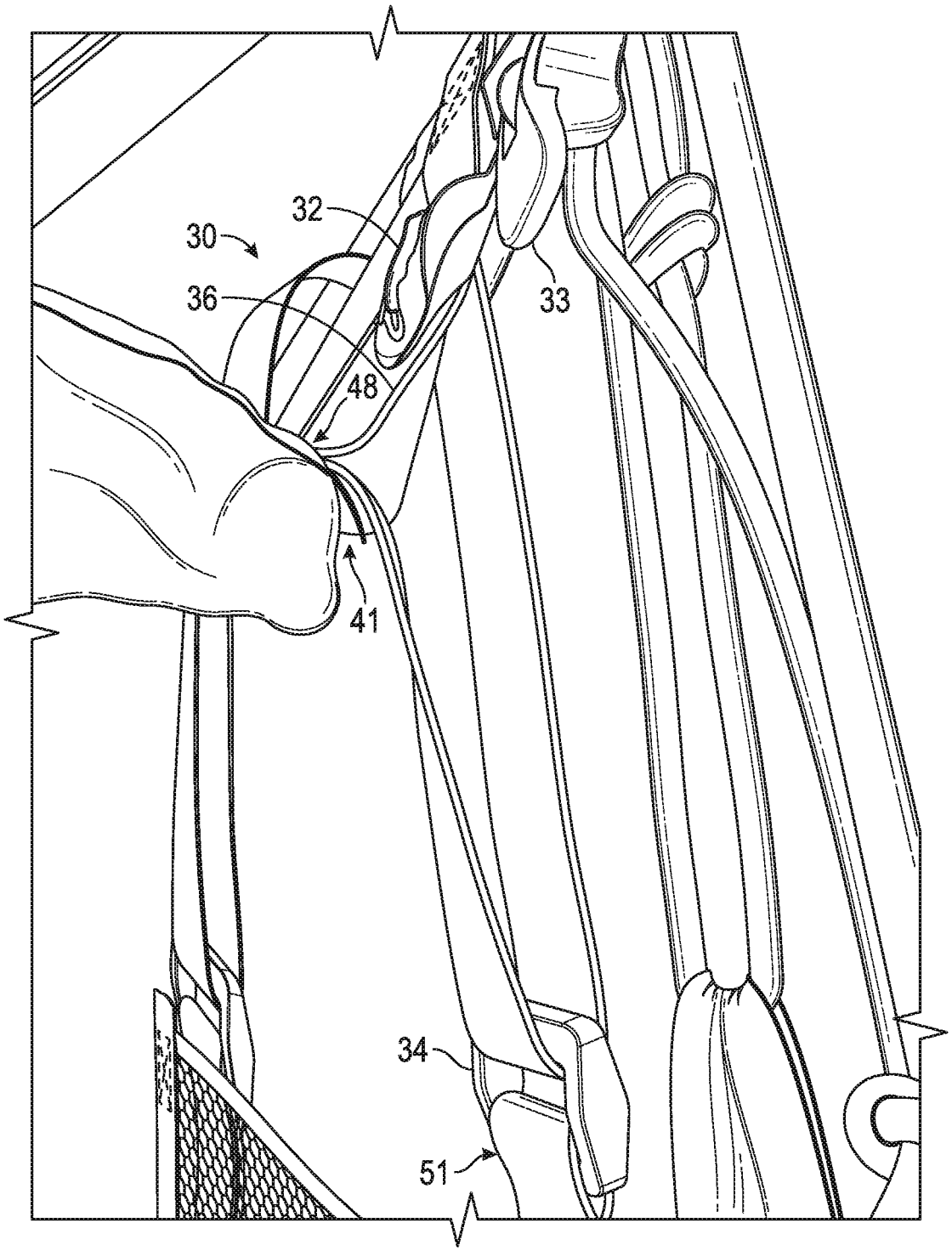
FIG. 3 is a detailed view of inset 3 of FIG. 1.
Figure 4:
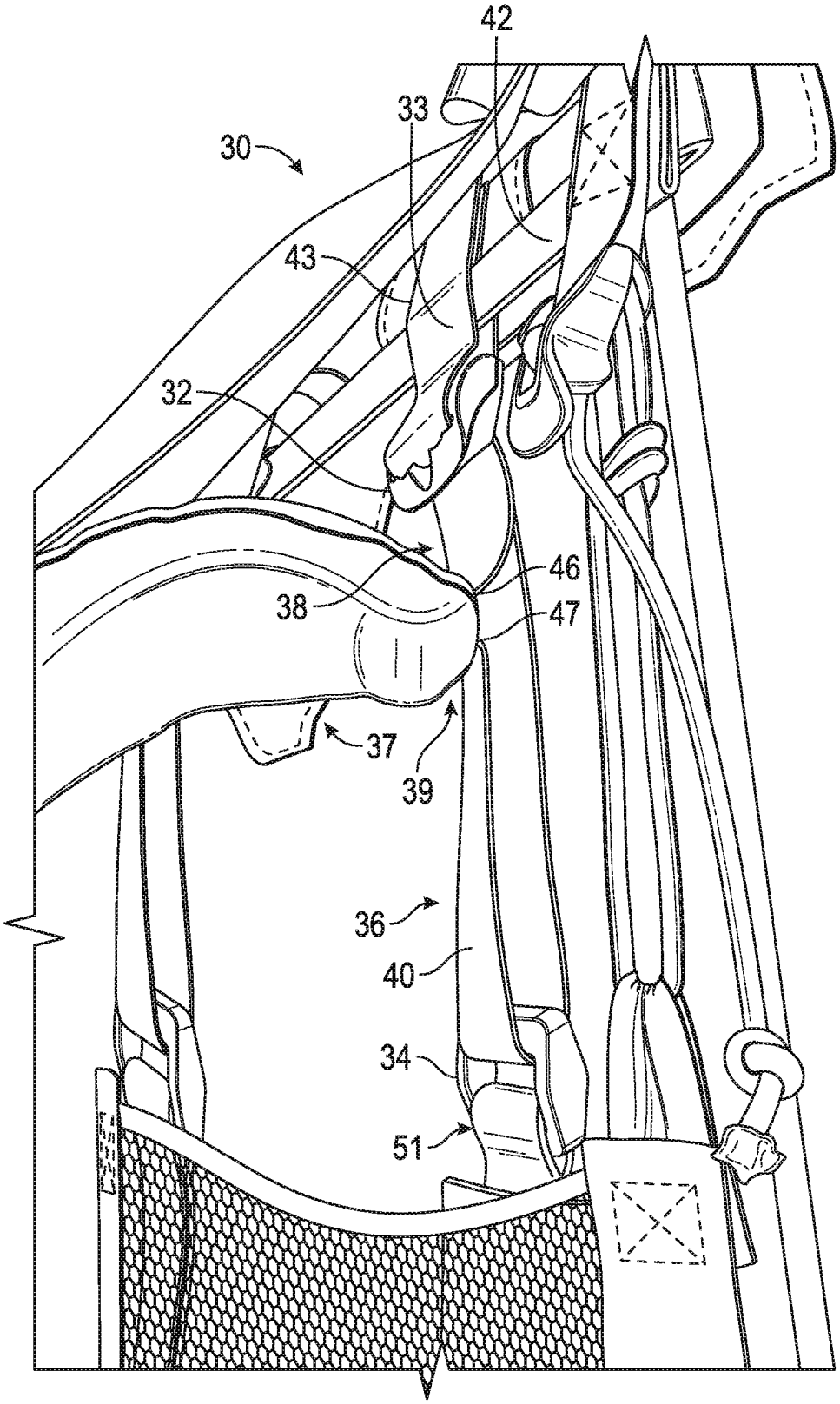
FIG. 4 is a left side perspective view of the strap height adjustment apparatus of FIG. 1.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

An embodiment of the invention, as shown and described by the various figures and accompanying text, provides a strap height adjustment apparatus 30. The strap height adjustment apparatus 30 may include a backpack 31, a locking strap adjuster 32, a non-locking strap adjuster 34, an adjusting strap 36, and a shoulder strap 37.

The backpack 31 may be any container adapted to be worn by a human or animal, and carried over at least one shoulder or appendage. The backpack 31 may be secured to at least one shoulder strap 37. In one embodiment, the backpack 31 may be carried over two shoulders and may include exactly two shoulder straps 31. The backpack 31 may be any bag, satchel, knapsack, pouch, pack, tote, or the like. The backpack 31 may be adapted to carry one or more items within a carrying compartment. The backpack 31 may be constructed, at least in part, from flexible material. The backpack 31 may be adapted to prevent water from entering the backpack 31.

The locking strap adjuster 32 may be secured to the backpack at a first attachment point 33. The first attachment point 33 may, for example, be connected to an elongate member. For example, the elongate member may be a part of a frame that extends along a width of the backpack. The locking strap adjuster 32 may be connected to a portion of the elongate member. Alternatively, the first attachment point 33 may be fixed on a portion of the backpack. Those skilled in the art will appreciate that connection of the locking strap adjuster 32 to the elongate member may also be achieved by connecting the locking strap adjuster 32 to a portion of the backpack, or by connecting a second attachment point member to a portion of the backpack so that the first attachment point 35 may be connected to the second attachment point member.

The locking strap adjuster 32 may be adapted to carry an adjusting strap 36. The locking strap adjuster 32 may include a first aperture through which the adjusting strap 36 may pass. The locking strap adjuster 32 may be adapted to adjustably secure the adjusting strap 36 within the locking strap adjuster 32. The adjusting strap 36 may be adjustably secured when the adjusting strap 36 may be selectably secured in more than one fixed relation to the locking strap adjuster 32. The fixed relation may be adjusted by manipulating the locking strap adjuster 32 to allow the adjusting strap 36 to move with respect to the locking strap adjuster 32. Absent manipulation of the locking strap adjuster 32, the relation between the locking strap adjuster 32 and the adjusting strap 36 may remain static. In one embodiment, the locking strap adjuster 32 may be a ladder lock. In embodiments in which a ladder lock is utilized, applying upward pressure to the ladder lock may allow the adjusting strap 36 to be adjusted within the locking strap adjuster 32. Absent upward pressure on the locking strap adjuster 32, the adjusting strap 36 may be retained at a fixed location by the locking strap adjuster 32. The locking strap adjuster 32 may be adapted to include a connection portion. The connection portion may be utilized to secure the locking strap adjuster 32 to the backpack 31. The connection portion may be a second aperture through which a locking strap adjuster attachment strap 43 may pass. The locking strap adjuster 32 may be adapted to carry a locking strap adjuster attachment strap 43. The locking strap adjuster attachment strap 43 may have a first and an opposing second end, both of which may secure to the backpack forming a loop upon which the locking strap adjuster 32 may be carried.

A non-locking strap adjuster 34 may be secured to the backpack at a second attachment point 35. The non-locking strap adjuster 34 may be adapted to carry the adjusting strap 36. The non-locking strap adjuster 34 may include a first aperture through which the adjusting strap 36 may pass. The non-locking strap adjuster 34 may be adapted to movably retain the adjusting strap 36 within the non-locking strap adjuster 34. The adjusting strap 36 may be movably retained when the adjusting strap 36 may move freely within the non-locking strap adjuster 34. By way of example, and not as a limitation, the non-locking strap adjuster 34 may be a d-ring, a square ring, or the like. The non-locking strap adjuster 34 may be adapted to include a connection portion. The connection portion may be utilized to secure the non-locking strap adjuster 34 to the backpack 31. The connection portion may be a second aperture through which a non-locking strap adjuster attachment strap 51 may pass. The non-locking strap adjuster attachment strap 51 may have a first and an opposing second end, both of which may secure to the backpack forming a loop upon which the non-locking strap adjuster 34 may be carried.

A shoulder strap 37 may have an upper end and a lower end. The lower end of the shoulder strap 37 may secure to the backpack 31. The upper end of the shoulder strap 37 may secure to the adjusting strap 36 at a shoulder strap attachment point 41. The shoulder strap attachment point 41 may be configured to be adjustably positioned along a length between the locking strap adjuster 32 and the non-locking strap adjuster 34. Adjusting the fixed relation of the adjusting strap 36 with respect to the locking strap adjuster 32 may adjust the position of the shoulder strap attachment point 41 along the length. Positioning the adjusting strap 36 at different fixed relations with respect to the locking strap adjuster 32 may adjust the height of the attachment of the upper end of the shoulder strap 37 to the backpack 31. This adjustment may result in raising or lowering the placement of the backpack 31 with respect to a user's body when the strap height adjustment apparatus 30 is worn over the shoulder or shoulders of the user.

The locking strap adjuster 32 and the non-locking strap adjuster 34 may carry an adjusting strap 36. The adjusting strap 36 may be adapted to form a continuous loop. The adjusting strap 36 may have a first end portion 38 and an opposing second end portion 39. The first end portion 38 may be fixedly secured to the second end portion 39 to form a continuous loop. The adjusting strap 36 may be adapted to pass through and be carried by an aperture in the locking strap adjuster 32 and also an aperture in the non-locking strap adjuster 34. The adjusting strap 36 may be a fixed length. The adjusting strap 36 may move freely within the aperture of the non-lacking strap adjuster 34. The adjusting strap 36 may be fixedly carried by the locking strap adjuster 32. "Fixedly carried by" may mean that at least one portion of the adjusting strap 32 may be impeded from movement by the locking strap adjuster 32. The adjusting strap 36 may have an inner portion and an opposing outer portion 40. The inner portion may define the inner perimeter of the loop. The shoulder strap 37 may secure to the outer portion 40 of the adjusting strap 36. The shoulder strap attachment point 41 may be located proximate the connection of the first end to the second end. The shoulder strap attachment point 41 may be the portion of the adjusting strap 32 defined by the connection of the first end to the second end.

The adjusting strap 36 may be adjustably carried by the locking strap adjuster 32. The adjusting strap 36 may be constructed, at least in part, from nylon webbing material. The adjusting strap 36 may be constructed entirely from nylon webbing material. The locking strap adjuster 32 may be adapted to prevent or limit free movement of the adjusting strap 36 through the locking strap adjuster 32. The locking strap adjuster 32 may be a ladder lock configured to prevent movement of the adjusting strap 36 when the backpack 31 is worn by a user. The locking strap adjuster 32 may be secured to the backpack 31 at a location higher than the non-locking strap adjuster 34. The shoulder strap 37 may be secured to an outer portion 40 of the adjusting strap 36 below the locking strap adjuster 32. When the backpack 31 is worn, the shoulder strap 37 may apply an upward force to the adjusting strap 36, which in turn may apply an upward force on the locking strap adjuster 32, which may prevent or limit movement of the adjusting strap 36 through the locking strap adjuster 32.

The locking strap adjuster 32 may be positioned in vertical alignment with the non-locking strap adjuster 34. "Vertical alignment" may occur when the locking strap adjuster 32 and the non-locking strap adjuster 34 are oriented to allow the adjusting strap 36 to be carried by both adjusters 32, 34 and extend orthogonally from each of the adjusters 32, 34 simultaneously.

Figure 5:
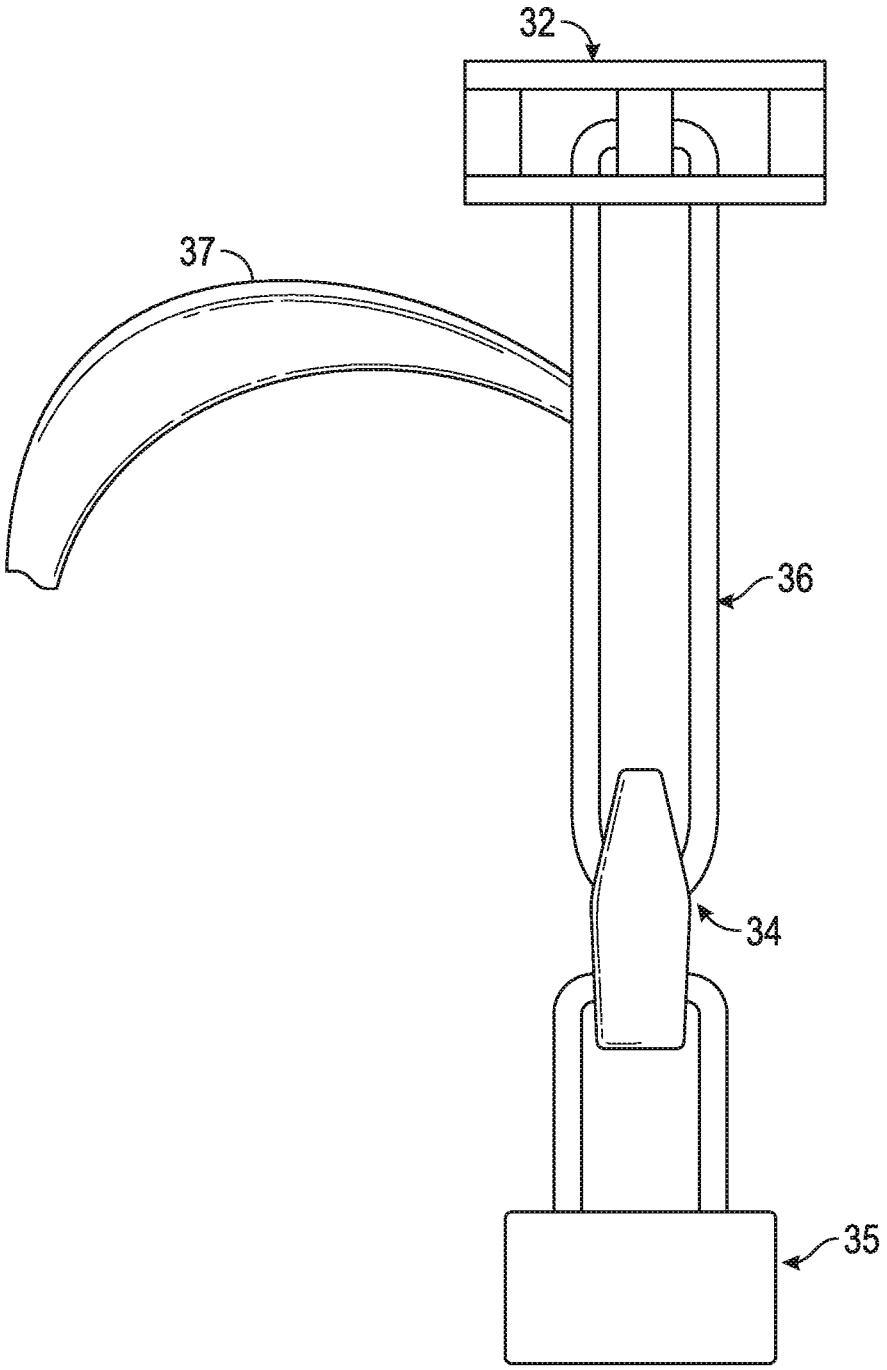
FIG. 5 is a left side elevation view of the strap height adjustment apparatus of FIG. 1.

A user may apply downward pressure to the shoulder strap 37, which will in turn apply downward pressure on the adjusting strap 36 and enable the adjusting strap 36 to move through the locking strap adjuster 32. As shown in FIG. 5, the locking strap adjuster 32 may be positioned at release angle, which may be 90°, relative to its nominal operating position. At the release angle, upward pressure may be applied to the shoulder strap 37, which will in turn apply upward pressure to the adjusting strap 36 and allow the adjusting strap 36 to move within the aperture of the locking strap adjuster 32 carrying the adjusting strap 36. Movement of the adjusting strap 36 through the locking strap adjuster 32 may alter the height of the shoulder strap 37 with respect to the back pack 31. Adjustment of the shoulder strap 37 height may be beneficial to the user by increasing comfort or decreasing fatigue.

The backpack 31 may have a horizontal support member 42 secured thereto. The horizontal support member 42 may extend across an upper back portion of the backpack 31. The horizontal support member 42 may extend the entirety of the distance between a first shoulder strap's 37 attachment point 41 and a second should strap's 37 attachment point 41. The adjusting strap 36 may be configured in a direction orthogonal to the length of the horizontal support member 42. The locking strap adjuster 32 may be secured to the horizontal support member 42. A locking strap adjuster attachment strap 43 may be carried by the backpack 31 and may carry the locking strap adjuster 32 or the horizontal support member 42. The locking strap adjuster attachment strap 43 may secure the locking strap adjuster 32 or the to the horizontal support member 42 to the backpack 31. The locking strap adjuster attachment strap 43 may be adapted to carry the locking strap adjuster 32. The locking strap adjuster attachment strap 43 may be adapted to carry the horizontal support member 42. The locking strap adjuster attachment strap 43 may be material with a length having a first end and an opposing second end. The first end may be affixed to the backpack 31. A first portion of the length may be located beneath the horizontal support member 42. A second portion of the length may pass through an aperture of the locking strap adjuster 32 and be adapted to carry the locking strap adjuster 32. A third portion of the length may be located above the horizontal support member 42. The length of material may be adapted to carry the horizontal support member 42 between the first and third portions. The second end may secure to the first end. The locking strap adjuster attachment strap 43 may be affixed to the backpack 31. The locking strap adjuster attachment strap 43 may be flexible. The locking strap adjuster attachment strap 43 may flexibly affix the locking strap adjuster 32 to the backpack 31.

A non-locking strap adjuster attachment strap 51 may be carried by the backpack 31 and may carry the non-locking strap adjuster 34. The non-locking strap adjuster attachment strap 51 may secure the non-locking strap adjuster 34 to the backpack 31. The non-locking strap adjuster attachment strap 51 may be adapted to carry the non-locking strap adjuster 34. The non-locking strap adjuster attachment strap 51 may be material with a length having a first end and an opposing second end. The first end may be affixed to the backpack 31. A middle portion of the length may pass through an aperture of the non-locking strap adjuster 34 and be adapted to carry the non-locking strap adjuster 34. The second end may secure to the first end. The non-locking strap adjuster attachment strap 51 may be affixed to the backpack 31. The non-locking strap adjuster attachment strap 51 may be flexible. The non-locking strap adjuster attachment strap 51 may flexibly affix the non-locking strap adjuster 34 to the backpack 31.

An adjusting strap connection portion 48 may be affixed to the shoulder strap 37. The adjusting strap connection portion 48 may have an adjusting strap first end portion first side 46 and an adjusting strap second end portion first side 47. The adjusting strap first end portion first side 46 may be a portion of the adjusting strap 36 located on the inner portion of the adjusting strap 36 at the first end portion 38. The adjusting strap second end portion first side 47 may be a portion of the adjusting strap 36 located on the inner portion of the adjusting strap 36 at the second end portion 39. The adjusting strap first end portion first side 46 may be secured to the adjusting strap second end portion first side 47 to form a shoulder strap securement portion. The shoulder strap securement portion may be secured to the shoulder strap 37. The shoulder strap securement portion may be secured directly to an upper side of the shoulder strap 37.

The backpack 31 may have an upper half defined as the half of the backpack 31 that is furthest from the ground when worn by a user. The backpack 31 may have a back portion defined as the side of the backpack 31 positioned along the user's back when worn by a user. The backpack 31 may have an upper back half portion defined as the upper half of the back portion of the backpack 31. The non-locking strap adjuster 34 may be affixed to the upper back half portion of the backpack 31. The locking strap adjuster 32 may be affixed to the upper back half portion of the backpack 31.

The backpack 31 may have an upper quarter portion defined as the quarter of the backpack 31 that is furthest from the ground when worn by a user. The backpack 31 may have an upper back quarter portion defined as the upper quarter of the back portion of the backpack 31. The non-locking strap adjuster 34 may be affixed to the upper back quarter portion of the backpack 31. The locking strap adjuster 32 may be affixed to the upper back quarter portion of the backpack 31.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus, the scope of the invention should be determined by the appended claims and their legal equivalents, and not by the examples given.

That which is claimed is:

1. A strap height adjustment apparatus comprising:

a backpack having a back surface with a top edge, a bottom edge, and a centerline equidistant from the top edge and the bottom edge;

a locking strap adjuster secured to the back surface of the backpack at a first attachment point located above the centerline;

a non-locking strap adjuster secured to the back surface of the backpack at a second attachment point located above the centerline;

an adjusting strap configured to be carried by the locking strap adjuster and the non-locking strap adjuster; and a shoulder strap secured to the adjusting strap at a shoulder strap attachment point.

2. The strap height adjustment apparatus according to claim 1 wherein the adjusting strap is adapted to form a continuous loop.

3. The strap height adjustment apparatus according to claim 1 wherein the shoulder strap is secured to an outer portion of the adjusting strap.

4. The strap height adjustment apparatus according to claim 1 wherein the shoulder strap attachment point is configured to be adjustably positioned between the non-locking strap adjuster and the locking strap adjuster.

5. The strap height adjustment apparatus according to claim 1 wherein the locking strap adjuster is secured to the backpack in vertical alignment with the nonlocking strap adjuster.

6. The strap height adjustment apparatus according to claim 1 further comprising:

a horizontal support member secured to the backpack and extending between the first locking strap adjuster and the second locking strap adjuster;

wherein the locking strap adjuster is secured to the horizontal support member.

7. The strap height adjustment apparatus according to claim 1 further comprising:

an adjusting strap connection portion affixed to the shoulder strap and comprising:

an adjusting strap first end portion first side; and an adjusting strap second end portion first side secured to the adjusting strap first end portion first side.

8. The strap height adjustment apparatus according to claim 1 wherein the non-locking strap adjuster and the locking strap adjuster are affixed to an upper back quarter portion of the backpack.

9. The strap height adjustment apparatus according to claim 1 wherein the locking strap adjuster further comprises a ladder lock.

10. The strap height adjustment apparatus according to claim 1 wherein the non-locking strap adjuster further comprises a square ring.

11. The strap height adjustment apparatus according to claim 1 further comprising:

a locking strap adjuster attachment strap adapted to carry the locking strap adjuster and affixed to the backpack; and a non-locking strap adjuster attachment strap adapted to carry the non-locking strap adjuster and affixed to the backpack.

12. The strap height adjustment apparatus according to claim 1 wherein the locking strap adjuster is flexibly affixed to the backpack.

13. The strap height adjustment apparatus according to claim 1 wherein the non-locking strap adjuster is flexibly affixed to the backpack.

14. The strap height adjustment apparatus according to claim 1 wherein the adjusting strap further comprises:

a nylon webbing material.

15. A strap height adjustment apparatus comprising:

a backpack;

a first locking strap adjuster secured to the backpack at a first upper attachment point;

a first non-locking strap adjuster secured to the backpack in vertical alignment with the first locking strap adjuster at a first lower attachment point;

a second locking strap adjuster secured to the backpack at a second upper attachment point;

a second non-locking strap adjuster secured to the backpack in vertical alignment with the second locking strap adjuster at a second lower attachment point;

a first adjusting strap configured to be carried by the first locking strap adjuster and the first non-locking strap adjuster;

a second adjusting strap configured to be carried by the second locking strap adjuster and the second non-locking strap adjuster;

a first shoulder strap secured to an outer portion of the first adjusting strap at a first shoulder strap attachment point; and a second shoulder strap secured to an outer portion of the second adjusting strap at a second shoulder strap attachment point;

wherein the first shoulder strap attachment point is configured to be adjustably positioned between the first non-locking strap adjuster and the first locking strap adjuster; and wherein the second shoulder strap attachment point is configured to be adjustably positioned between the second non-locking strap adjuster and the second locking strap adjuster.

16. The strap height adjustment apparatus according to claim 15 further comprising:

a horizontal support member secured to the backpack;

wherein the first locking strap adjuster and the second locking strap adjuster are secured to the horizontal support member.

17. The strap height adjustment apparatus according to claim 15 further comprising:

a first adjusting strap connection portion affixed to the first shoulder strap and comprising:

a first adjusting strap first end portion first side; and a first adjusting strap second end portion first side secured to the first adjusting strap first end portion first side.

18. The strap height adjustment apparatus according to claim 15 wherein the backpack has a back surface with a top edge, a bottom edge, and a centerline equidistant from the top edge and the bottom edge;

wherein the first locking strap adjuster is secured to the back surface of the backpack at a first upper attachment point located above the centerline; and wherein the first non-locking strap adjuster is secured to the back surface of the backpack at a first lower attachment point located above the centerline.

19. A strap height adjustment apparatus comprising:

a backpack having a back surface with a top edge, a bottom edge, and a centerline equidistant from the top edge and the bottom edge;

a ladder lock secured to the backpack at a first attachment point located above the centerline;

a square ring secured to the backpack in vertical alignment with the ladder lock at a second attachment point located above the centerline;

a nylon webbing strap configured to form a continuous loop and to be carried by the ladder lock and the square ring;

a shoulder strap secured to an outer portion of the nylon webbing strap at a shoulder strap attachment point;

a ladder lock attachment strap affixed to the ladder lock and the backpack; and a square ring adjuster attachment strap affixed to the square ring and the backpack;

wherein the shoulder strap attachment point is configured to be adjustably positioned between the square ring and the ladder lock.

* * * * *